United States Patent [19]

Theurer

[11] 4,323,013

[45] Apr. 6, 1982

[54] MOBILE TRACK WORKING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 87,061

[22] Filed: Oct. 22, 1979

[30] Foreign Application Priority Data

Nov. 30, 1978 [AT] Austria ..... 8583/78

[51] Int. Cl.[3] ..... B61B 29/04

[52] U.S. Cl. ..... 104/7 B

[58] Field of Search ..... 104/1 R, 2, 7 R, 7 B, 104/8, 12

[56] References Cited

U.S. PATENT DOCUMENTS

| | | | |
|---|---|---|---|
| 978,858 | 12/1910 | Devitt | 104/8 |
| 3,381,625 | 5/1968 | Plasser et al. | 104/7 R |
| 3,595,170 | 7/1971 | Plasser et al. | 104/12 |
| 3,690,263 | 9/1972 | Plasser et al. | 104/8 |
| 3,832,952 | 9/1974 | Hurni | 104/7 B |
| 3,968,752 | 7/1976 | Theurer | 104/7 B |
| 4,064,807 | 12/1977 | Theurer | 104/7 A |

FOREIGN PATENT DOCUMENTS

| | | | |
|---|---|---|---|
| 2853529 | 11/1979 | Fed. Rep. of Germany | 104/7 B |
| 1581071 | 9/1969 | France | 104/7 R |
| 1540199 | 2/1979 | United Kingdom | 104/7 R |
| 591542 | 2/1978 | U.S.S.R. | 104/1 R |

*Primary Examiner*—Randolph A. Reese

*Attorney, Agent, or Firm*—Kurt Kelman

[57] ABSTRACT

An apparatus for lifting and laterally moving track in switch and open areas comprises a vertically and laterally movable tool carrier frame, a flanged wheel associated with each track rail and supporting the tool carrier frame for mobility on the track, a transversely adjustable gripping hook associated with each flanged wheel and mounted on the tool carrier frame for gripping engagement with the associated track rail from the outside thereof, and a gripping roller associated with each gripping hook and mounted on the tool carrier frame for grippingly subtending the rail head of the associated track rail from the outside thereof, each flanged wheel being centered between the associated gripping hook and gripping roller in the direction of track elongation.

5 Claims, 7 Drawing Figures

MOBILE TRACK WORKING MACHINE

The present invention relates to improvements in a mobile machine for working on a track, which includes a frame and an apparatus for lifting and laterally moving the track in switch and open track areas.

Railroad tracks include two rails fastened to ties, each rail having a head and the rails having outsides facing away from each other and insides facing each other in a direction transverse to the track. Open track areas are track sections free of switches or crossings, i.e. tangent or curved track over which train traffic moves freely.

In my U.S. Pat. No. 3,968,752, dated July 13, 1976, I have disclosed a track working machine of this type, wherein the apparatus for lifting and laterally moving the track comprises a tool carrier frame, power drive means connecting the tool carrier frame to the machine frame for vertically and laterally moving the tool carrier frame in relation to the machine frame, a pair of flanged wheels associated with each track rail and supporting the tool carrier frame for mobility on the track, each flanged wheel engaging the inside of the associated rail head and serving as a lateral rail moving element upon lateral movement of the tool carrier frame, and a transversely and vertically adjustable gripping hook mounted on the tool carrier frame centrally between the flanged wheels of each pair for gripping engagement with the associated track rail from the outside thereof. Hydraulic drives are provided for the transverse and vertical adjustment of the gripping hooks. Thus, each track rail is firmly gripped between the flanges of the wheels running on the upper face of the rail head and the hook grippingly subtending the head or the base of the rail, depending on the vertical adjustment thereof. This firm engagement of the track rails assures a proper transmission of the vertical and lateral moving forces from the tool carrier frame to the track. To enable the gripping hooks to operate properly at rail joints connected by a fishplate, the hooks may have a stepped configuration for engaging a projecting portion of the fishplate. The lifting and lining apparatus of this machine also has means for continuously and simultaneously moving the flanged wheels into substantially play-free engagement with the associated rails. The machine has been very successful in commercial operations, particularly where track work proceeds in switch areas, requiring only that one of the gripping hooks be moved into an inoperative position at the frog point so that the track is engaged only by one hook at this point.

U.S. Pat. No. 3,690,263, dated Sept. 12, 1972, discloses a mobile apparatus for laterally moving track whose tool carrier frame runs on flanged wheels and has a vertically adjustable lateral rail moving element mounted opposite each flanged wheel. The rail moving element may be adjusted between a rest and operating position independently of the flanged wheel for use in switch areas. The apparatus also provides a gripping hook arranged between two such flanged wheels associated with a respective track rail to enable the apparatus to be used for simultaneous lifting and lining. This machine has also been used successfully since the lateral moving elements engage each rail at two adjacent points whereby the force is distributed and a single-point force transmission to the rail is avoided.

U.S. Pat. No. 3,832,952, dated Sept. 3, 1974, also discloses a track working machine including an apparatus for lifting and laterally moving track in switch and open track areas. The vertically and laterally movable tool carrier frame of this apparatus comprises guides for moving lateral track moving tools substantially parallel to the plane of the track and for moving track lifting tools vertically to the track plane. The construction of the tools and their guides is complicated and, therefore, prone to breakdowns, and separate hydraulic drives are used for each tool, making the entire structure highly sensitive and subject to rapid wear. This shortcoming is enhanced by the fact that the apparatus is called upon to sustain the heavy weights of a track switch during lifting and to exert lateral force against this heavy weight during lining. In addition, the lifting hook faces the associated flanged wheel in a transverse plane so that each rail is engaged only at a single point, increasing the danger of bending the rail at this point under the heavy loads encountered during lifting and lining. To enable the tools to engage each rail properly, the flanged wheels are additionally movable relative to the tool carrier frame in the plane of the track, the additional hydraulic drives for this movement further complicating the overall structure, entailing additional maintenance problems and interfering with the visibility at the working site.

U.S. Pat. No. 3,595,170, dated July 27, 1971, discloses a mobile track tamper comprising a track lifting unit including pairs of flanged rollers glidingly gripping the track rails U.S. Pat. No. 4,064,807, dated Dec. 27, 1977, discloses a mobile track leveling and tamping machine comprising a track engaging unit including cooperating flanged wheels and gripping rollers wherebetween the track rails are firmly held.

It is the primary object of this invention to provide a mobile track working machine having the capability of lifting and laterally moving track in switch and open track areas with improved structure enabling relative high lifting and lining forces to be transmitted to the track at just about any point of the track.

It is another object of the invention to provide a simple structure accomplishing this result so that existing machine may be readily and relatively inexpensively equipped with the apparatus.

The above and other objects and advantages are accomplished according to the present invention with an apparatus for lifting and laterally moving the track in switch areas and open track areas, which comprises a tool carrier frame and power drive means connecting the tool carrier frame to the frame of the mobile track working machine for vertically and laterally moving the tool carrier frame in relation to the machine frame. A flanged wheel is associated with each track rail and supports the tool carrier frame for mobility of the track, each flanged wheel having a flange engaging the inside of the associated rail head and serving as a lateral rail moving element upon lateral movement of the tool carrier frame. A transversely adjustable gripping hook is associated with each flanged wheel and is mounted on the tool carrier frame for gripping engagement with the associated track rail from the outside thereof. According to this invention, a gripping roller is associated with each gripping hook and is mounted on the tool carrier frame for grippingly subtending the rail head of the associated track rail from the outside thereof, each flanged wheel being arranged between the associated gripping hook and gripping roller in the direction of track elongation.

With this combination of force-transmitting track rail engaging elements capable of lifting and laterally moving track in a mobile track working machine, an unexpectedly simple arrangement is provided for adapting the operation readily to the various requirements for engaging different rail sections encountered on the open road and in switches and crossings. Even in its simplest structural embodiment, the apparatus of the invention provides each flanged wheel with the selected or simultaneous cooperation of two differently structured gripping elements, i.e. a hook and a roller, for gripping engagement with the associated track rails from the outside thereof to form a firm pincer grip for the rail. The arrangement of the flanged wheel centered between the associated gripping hook and gripping roller in the direction of track elongation enables at least one of the two outside gripping elements to engage the track rail at difficult track points, such as rail joints or frogs. Thus, under all operating conditions, the track moving force will always be transmitted through at least one gripping element cooperating with the flanged wheel to provide a pincer grip for the track rail. Providing a selectively or simultaneously usable gripping hook and gripping rollers has the advantage that the best suited tool may be used at any given track point to facilitate and expedite the track work. Thus, in open track areas and where relatively little lifting is required, only the gripping rollers may be used for effective operation while the gripping hooks will be used additionally at track joints held together by fishplates. This will provide the type of non-stop operation described, for example, in U.S. Pat. No. 4,064,807. On the other hand, in track correction work in switches and crossings, there may not be enough room at the outside of the rail in the frog area to enable a gripping roller to be used, in which case the gripping hooks remain engaged with the rail. If the gripping hooks, in addition to being transversely adjustable, are also vertically movable, additional operating possibilities are available. For example, where so little space is available at the outside of the rail that neither the gripping roller nor the gripping hook can be transversely adjusted for engagement with the rail, the gripping hook may be lowered so that it may be pivoted into subtending engagement with the base of the rail.

The above and other objects, advantages and features of the invention will become more apparent from the following detailed description of certain now preferred embodiments thereof, taken in conjunction with the accompanying schematic drawing wherein FIG. 1 is a side elevational view of one embodiment of a mobile track working machine according to the present invention;

FIG. 2 is an enlarged side elevational view of the apparatus for lifting and laterally moving the track according to FIG. 1;

FIG. 3 also shows the apparatus of FIG. 2, the right half of the figure being an end view thereof and the left half of the figure being a section along line III—III of FIG. 2;

Figure 1:
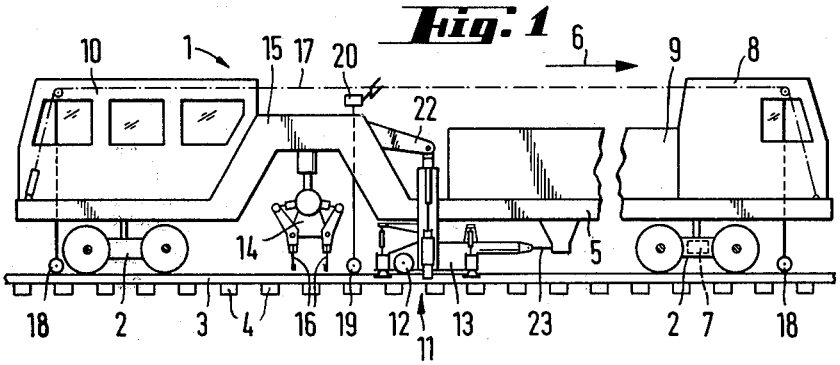
Figure 2:
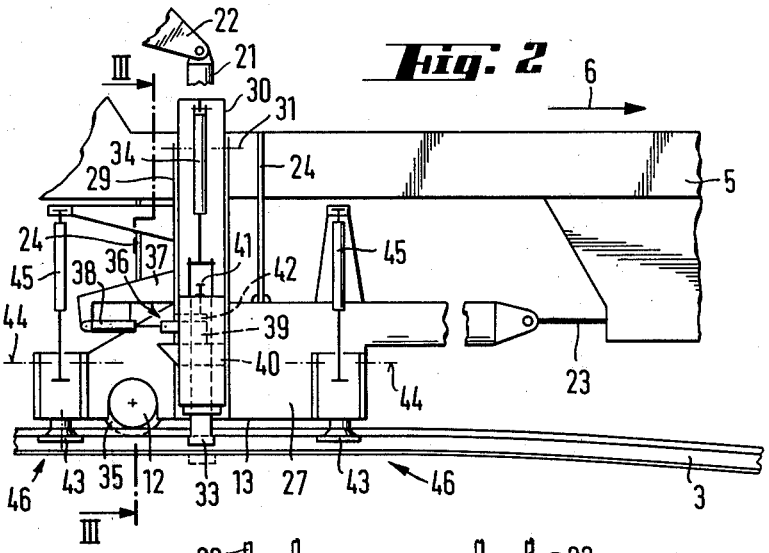
Figure 3:
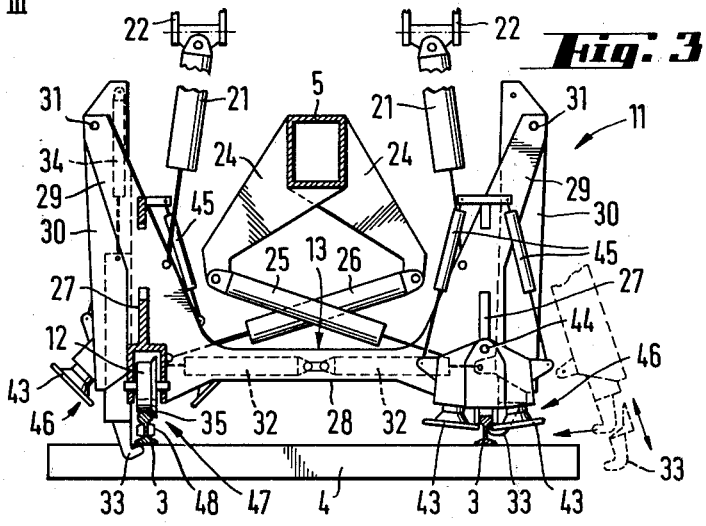

Referring now to the drawing, wherein like references numerals designate like parts operating in a like manner in all figures, and first to FIGS. 1 to 3, there is shown, as an embodiment of a mobile machine for working on a track, a track tamping, leveling and lining machine 1 including frame 5 supported on swivel trucks 2 for mobility on a track including two rails 3 fastened to ties 4, each rail having a head and the rails having outsides facing away from each other and insides facing each other in a direction transverse to the track. The machine moves in an operating direction indicated by arrow 6 and front truck 2 has drive 7 for propelling the machine along the track in the operating direction. Machine frame 5 carries front operator's cab 8 and, adjacent thereto, housing 9 containing the power plant for the machine. Another cab 10 is mounted on frame 6 at the rear thereof.

Apparatus 11 for lifting and laterally moving the track in switch areas and open track areas comprises tool carrier frame 13 and power drive means illustrated as hydraulic motors 21, 25 and 26 connecting tool carrier frame 13 to machine frame 5 for vertically and laterally moving the tool carrier frame in relation to the machine frame. Flanged wheels 12 associated with track rails 3 support tool carrier frame 13 for mobility on the track, each flanged wheel having flange 35 engaging the inside of the associated rail head and serving as a lateral rail moving element upon lateral movement of the tool carrier frame by respective hydraulic motors 25 or 26.

Upwardly projecting bridge portion 15 of machine frame 5 between rear swivel truck 2 and lifting and lining apparatus 11 carries tamping head 14 of generally conventional structure and comprising reciprocating tamping tools 16. In a known manner, the tamping head is adapted for switch tamping.

As is also well known, lining and leveling of the track is made possible by provision of a diagrammatically indicated reference system 17 including rail sensing element 18 and control element 20 responsive to the reference system and controlling the operation of lifting and lining motors 21, 25 and 26.

The structure of apparatus 11 is more fully shown in FIGS. 2 and 3 which illustrate a pair of hydraulic lifing motors 21 linked respectively to brackets 22 projecting from machine frame 5 and to tool carrier frame 13 for lifting the tool carrier frame in relation to the machine frame. In addition to being vertically movable, the tool carrier frame may also be adjusted in the direction of track elongation in relation to the machine frame, for which purpose tool carrier frame 13 is connected to machine frame 5 by hydraulic motors 23 extending in the direction of track elongation. A yoke comprised of two arms 24, 24 is affixed to machine frame 5, the yoke arms being staggered from each other in the direction of track elongation and respectively projecting towards track rails 3, and hydraulic lining motors 25 and 26 are respectively linked to the yoke arms and to tool carrier frame 13 for laterally moving the tool carrier frame in a selected transverse direction in relation to the machine frame.

Tool carrier frame 13 illustrated herein is comprised essentially of two lateral frame parts 27, 27, each lateral frame part extending above and along an associated track rail 3, and a transverse frame part 28 interconnecting and bracing the two lateral frame parts intermediate their ends and centrally thereof, transverse frame part 28 having two upwardly projecting carrier arms 29, 29 in the areas of lateral frame parts 27. An elongated, downwardly extending frame-like guide part 30 is mounted on each carrier arm 29, an upper end of the guide part being pivoted to an upper end of the carrier arm and each guide part 30 being pivotal about axis 31 extending parallel to the direction of track elongation. Hydraulic pivoting motors 32 are mounted in transverse frame part 28 and each pivoting motor is respectively linked to the transverse frame part and a respective guide part 30 so that the guide part may be pivoted about axis 31. Gripping hook 33 has a holding portion glidably mounted in frame-like guide part 30 and hydraulic motor 34 is respectively connected to the guide part and the holding portion of the gripping hook for vertically moving the hook in relation to the guide part.

The above-described arrangement provides for transverse and vertical adjustment of the gripping hook so that hook 33 may be selectively engaged from the outside of the rail either subtending the rail head or the rail base while the flanged wheel 12 engages the inside of the rail head. As shown in FIG. 2 (and omitted from FIG. 3 to avoid undue crowding of this figure), adjustable blocking device 36 is mounted on each pivotal guide part 30 to fix gripping hook 33 at a desired vertical level. The blocking device comprises bracket 37 projecting from guide part 30, gliding part 30 movable in the direction of track elongation and hydraulic motor 38 respectively connected to bracket 37 and gliding part 30 for moving the gliding part in this direction. The gliding part is movable into and out of a space defined between abutment 40 fixedly mounted on the gripping hook holding portion within frame-like guide part 30 and abutment 42 whose position may be adjusted by set screw 41.

In accordance with this invention, apparatus 11 comprises a gripping roller associated with each gripping hook 33 and mounted on tool carrier frame 13 for grippingly subtending the rail head of the associated track rail from the outside thereof, each flanged wheel 12 being centered between the associated gripping hook and gripping roller in the direction of track elongation. In the embodiment of FIGS. 1–3, two such gripping rollers 43, 43 are spaced from each other in the direction of track elongation and gripping hook 33 associated with each track rail 3 is arranged centrally between the two gripping rollers. This arrangement provides an advantageous force transmission and distribution, particularly during lifting, which protects the rails and the tool carrier frame from excessive loads at any one point. Gripping rollers 43, 43 are mounted at the respective ends of lateral frame parts 27 and are pivotal about common axis 44 extending in the direction of track elongation for transverse adjustment of the gripping rollers to subtend the rail head of the associated track rail from the outside thereof. Separate hydraulic motor 45 is respectively connected to lateral frame part 13 and each gripping roller for individual operation of the gripping rollers.

According to another preferred feature, a further gripping roller 43 is associated with each outside gripping roller and forms gripping roller pair 46 therewith, the further gripping roller being mounted on the tool carrier frame for grippingly subtending the rail head of associated track rail 3 from the inside thereof. As shown, the gripping rollers of each pair are pivotal about common axis 44 and can be pivoted by separate hydraulic motors 45 so as to provide a pincer grip when commonly operated. In this manner, it is possible to transmit moving forces to the track at two spaced points which are firmly and securely gripped from the inside and the outside. Since each gripping roller has its own drive, the rollers may be operated independently from a control operator's cab, as working conditions may require.

In FIGS. 2 and 3, pairs 46 of gripping rollers 43, 43 associated with right rail 3 are shown in their rail engaging position, i.e. in pincer engagement with the rail head, and hook 33 is in subtending engagement with the head of right rail 3. Thus, the lifting forces exerted by hydraulic motors 21, 21 are transmitted by tool carrier frame 13 simultaneously at five points to right rail 3. The rail is lifted and elastically bent in the manner shown in FIG. 2. The lifting stroke produced by apparatus 11 as well as the tamping by tamping head 14 is controlled in a known manner by the reference system.

The right side of FIG. 3 also shows guide part 30 in a pivoted and hook 33 in a lowered position (broken lines). The left side of the figure shows the position of the gripping elements at rail joint 47 whose abutting ends of two rail sections are connected by fishplates 48. Since the fishplates at the joint prevent gripping rollers 43 from engaging the rail head, they are pivoted upwardly into their open position. If the fishplates extend into the range of gripping hook 33, thus also preventing its subtending engagement with the rail head, it is lowered by hydraulic motor 34 so that it may subtend the base of left rail 33, guide part 30 being pivoted about axis 31 by motor 32 to engage the hook with the rail base. In this case, the lifting forces are transmitted to the rail by hook 33 and rear pair 46 of the gripping rollers (not visible in FIG. 3).

Figure 4:
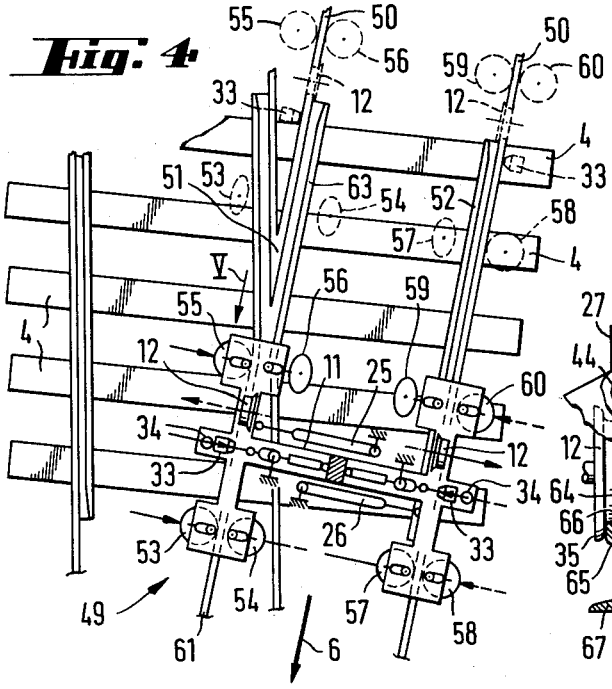
FIG. 4 is a diagrammatic top view of the apparatus of FIGS. 1—3 in use in the frog area of a track switch.

The operation of the machine illustrated in FIGS. 1 to 3 is further elucidated in FIG. 4 in connection with the lifting and lining of track switch 49. For the sake of clarity, only lifting and lining apparatus 11 has been diagrammatically shown in this figure.

The machine is moved into switch 49 in the direction of arrow 6 from branch track 50 and, in the position shown in full lines, apparatus 11 is still in the range of frog 51 and guide rail 52 of branch track 50. The weight of the track switch components and the resistance to lateral movement by the extra-long ties require considerably greater lifting and lining forces than are needed at regular track sections. Therefore, it is of decisive importance that the track rail gripping elements of apparatus 11 have as rigid an engagement with the rails as possible and distribute the lifting and lining forces favorably over the gripped track switch section. For a better understanding of the gripping engagement conditions, the positions of gripping rollers 43 have been designated by numerals 53 to 60 in FIG. 4. The engagement position of these gripping rollers subtending the rail heads of rails 61 and 62 has been indicated in the drawing by tangential contact of the respective rollers.

As shown, the gripping rollers in positions 53–55 and 57, 58 and 60 are in gripping engagement with rails 61 and 62, respectively, while the rollers 56 and 59 are inwardly pivoted into their rest position out of engagement with the insides of the rails because rail 63 of frog 51 and guide rail 52 of branch track 50 prevent gripping engagement of the inside rollers with rails 61 and 62 at this point. Gripping hooks 33 are in engagement with the rails, as symbolically indicated. Thus, the lifting forces will be transmitted to the track swtich at eight points distributed substantially uniformly over the lifting zone.

Figure 5:
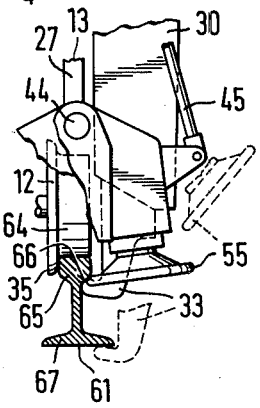
FIG. 5 is a fragmentary end view of the apparatus in the direction of arrows V in FIGS. 4, 6 and 7, showing the track rail engaging elements in operation.

During lining, as well known in FIG. 5, flanges 35 of flanged wheels 12 cooperate with the flanges of the gripping rollers engaging the rails from the outsides to hold the rails in a pincer grip. When the track which is laterally moved by hydraulic motor 26 to the right, as shown by transverse arrows in full lines, the lining force is transmitted to the switch at five points, i.e. 33, 53 and 55 at rail 61 and 12 and 57 at rail 62. When motor 25 moves the switch to the left, as shown by transverse arrows in broken lines, there also are five force transfer points, i.e. 54 and 12 at rail 61 and 58, 60 and 33 at rail 62.

The upper portion of FIG. 4 shows another significant working position of apparatus 11 in broken lines, as the machine approaches frog 51 on branch track 50. Even in this relatively unfavorable position, the lifting foces are transmitted to the track at seven points, i.e. the gripping rollers in engagement with the track rails at 55, 56, 58, 59, 60 and both hooks 33. Only gripping rollers 53, 54 and 57 in the range of the frog and guide rail are out of rail engagement and in their lateral rest position. For lateral movement to the right, one flanged wheel 12, a gripping hook 33 and gripping rollers 55 and 59 are in position. For movement to the left, one flanged wheel and one gripping hook, as well as gripping rollers 56, 58 and 60 are operative.

Figure 6:
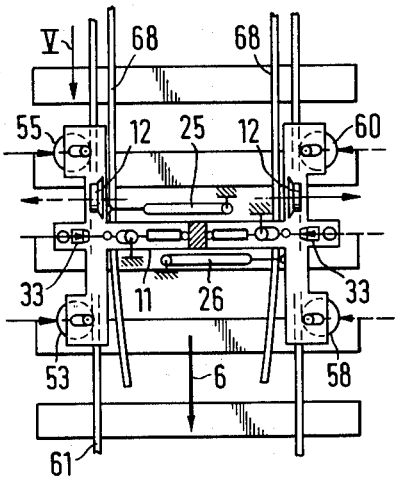
FIG. 6 is a top view similar to FIG. 4 and showing another embodiment of the apparatus.

FIG. 6 diagrammatically illustrates another embodiment of this invention wherein one flanged wheel 12, one gripping hook 33 and two longitudinally spaced gripping rollers 53, 55 and 58, 60 are associated with each rail, the gripping rollers being arranged for grippingly subtending the rail head of the associated track rail from the outside thereof. Apparatus 11 has been shown in this figure during work on a straight track in a transition zone equipped with inside guide rails 68, such as a tunnel or bridge track section. As can be readily appreciated from this figure, all the gripping elements may be operated without difficulty for transmitting the lifting and lining forces, without interference by guide rails 68.

Figure 7:
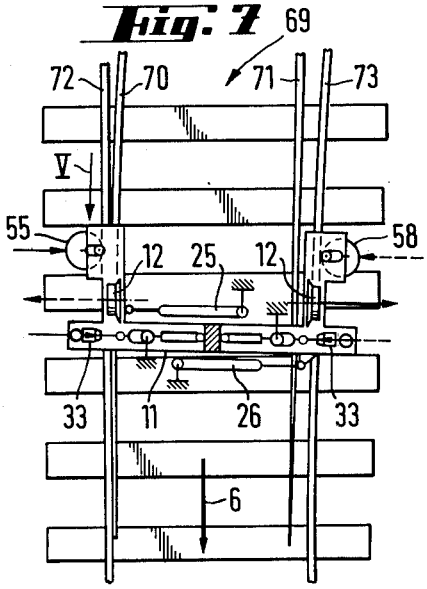
FIG. 7 is a like top view showing yet another embodiment of the apparatus in the area of a switch rail.

Yet another embodiment of apparatus 11 is diagrammaticallly shown in FIG. 7. The apparatus is illustrated at work in switch 69 actuated to direct train traffic to the right, as shown by the position of switch rails 70, 71 and 72, 73. In this embodiment, a single gripping roller 55 and 58 is associated with each rail. As long as apparatus 11 is in the range of the switch rails, both gripping rollers and both gripping hooks 33 may be operated to transmit the lifting forces while the lateral forces are transmitted at three points, i.e. gripping roller 55 or 58, gripping hook 33 and flanged wheel 12.

FIG. 5 shows the track rail engaging conditions of flanged wheel 12, gripping hook 33 and a respective gripping roller for all embodiments in greater detail, these conditions being shown in conjunction with gripping roller 55 and rail 61. As illustrated, running face 64 of flanged wheel 12 supports apparatus 11 on the surface of rail head 65 while flange 35 of the wheel engages the inside of the rail head. The flange of gripping roller 55 and gripping hook 33 in the upper position grippingly subtend underside 66 of rail head 65, thus forming a pincer grip around the rail head with the flanged wheel. As shown in broken lines, if the gripping hook is prevented from subtending the rail head, it is lowered to subtend rail base 67 while the gripping roller is pivoted outwardly into a rest position.

While the present invention has been described in connection with specific structural embodiments and in connection with a track tamper, many variations may occur to those skilled in the art and apparatus 11 may also be used on other track working machines, such as mobile ballast cleaning machine, mobile track liners and the like.

What is claimed is:

1. In a mobile machine for working on a track including two rails rastened to ties, each rail having a head and the rails having outsides facing away from each other and insides facing each other in a direction transverse to the track, the machine including a frame and an apparatus for lifting and laterally moving the track in switch areas and open track areas, the apparatus comprising (a) a tool carrier frame, (b) power drive means connecting the tool carrier frame to the machine frame for vertically and laterally moving the tool carrier frame in relation to the machine frame, (c) a single flanged wheel associated with each track rail and supporting the tool carrier frame for mobility on the track, (1) each flanged wheel having a flange engaging the inside of the associated rail head and serving as a lateral rail moving element upon lateral moving of the tool carrier frame, (d) a transversely adjustable gripping hook associated with each flanged wheel and mounted on the tool carrier frame for gripping engagement with the associated track rail from the outside thereof, and (e) a gripping roller associated with each gripping hook and mounted on the tool carrier frame for grippingly subtending the rail head of the associated track rail from the outside thereof, and for holding the associated track rail during vertical movement of the tool carrier frame, (1) each flanged wheel being centered between the associated gripping hook and gripping roller in the direction of track elongation.

2. In the mobile track working machine of claim 1, a further gripping roller associated with at least one of the outside gripping rollers and forming a gripping roller pair therewith, the further gripping roller being mounted on the tool carrier frame for grippingly subtending the rail head of the associated track rail from the inside thereof.

3. In the mobile track working machine of claim 1 or 2, the gripping hooks and gripping rollers being pivotal about axes extending substantially parallel to the track for transverse adjustment, and a power drive connected to each gripping hook and roller for pivoting the same.

4. In the mobile track working machine of claim 1 or 2, two of said gripping rollers being spaced from each other in the direction of track elongation and the gripping hook associated with each track rail being arranged between the two gripping rollers.

5. In the mobile track working machine of claim 4, the gripping hook being centered between the two gripping rollers.

* * * * *